US005471751A

United States Patent [19]

Ball

[11] Patent Number: 5,471,751

[45] Date of Patent: Dec. 5, 1995

[54] LOW FRICTION GUIDE BAR FOR A CHAIN SAW

[75] Inventor: Stan Ball, Milan, Tenn.

[73] Assignee: Sandvik Windsor Corporation, Milan, Tenn.

[21] Appl. No.: 167,071

[22] Filed: Dec. 15, 1993

[51] Int. Cl.[6] ..... B27B 17/02

[52] U.S. Cl. ..... 30/383; 76/104.1; 76/112

[58] Field of Search ..... 30/383–387; 384/912; 76/25, 101.1, 104.4, 112

[56] References Cited

U.S. PATENT DOCUMENTS

| | | | |
|---|---|---|---|
| Re. 18,908 | 8/1933 | Van Derhoef | 384/912 |
| 2,962,812 | 12/1960 | Gommel . | |
| 3,124,177 | 3/1964 | Ekrud . | |
| 3,726,326 | 4/1973 | Coleman . | |
| 3,744,363 | 7/1973 | Espana | 30/383 |
| 3,991,799 | 11/1976 | Albright . | |
| 4,641,432 | 2/1987 | Kume . | |
| 4,722,141 | 2/1988 | Lim et al. . | |
| 4,958,670 | 9/1990 | Johnson . | |
| 4,970,789 | 11/1990 | Bell . | |
| 5,052,109 | 10/1991 | Vanderzanden et al. . | |
| 5,144,867 | 9/1992 | Yajima et al. . | |

*Primary Examiner*—Douglas D. Watts
*Attorney, Agent, or Firm*—Burns, Doane, Swecker & Mathis

[57] ABSTRACT

A guide bar for chain saws comprising a bar body made from a solid steel plate with a groove machined along the edges for guiding a saw chain. At least the portion of the groove sides closest to the edges of the bar body are plated with a first material layer of a thickness related to the average surface roughness (Ra) of the groove sidewalls and thereafter are plated with a much thinner second material layer.

16 Claims, 1 Drawing Sheet

LOW FRICTION GUIDE BAR FOR A CHAIN SAW

BACKGROUND AND SUMMARY OF THE PRESENT INVENTION

Guide bars for chain saws are usually made either laminated from three thin plates that are joined by spot welding or adhesives, or solid from one thicker plate. The latter type is preferred when the saw is subject to severe stresses. The solid plate requires machining of a circumferential groove to guide the drivelinks of the saw chain.

The machining is done either by milling or by grinding. Either method produces a groove with rough side walls, depending on feed and radial clearance. Typical average surface roughness values are Ra=5 to 10 microns.

One frequent mode of failure of guide bars is through wear of the groove to such an extent that it fails to guide the saw chain properly. Such improper guiding is manifested by vibrations and torsion stresses in the saw chain. Solid guide bars are known to wear faster and cause more wear to the saw chain than laminated bars, where the groove side walls are formed by the smooth rolled surface of the plates. To some extent hardening of the edges of the guide bar can delay the wear. However, hardening has limits since it is accompanied by brittleness and possible failure by cracking.

The present invention relates to a solid guide bar which has been further treated after machining of the groove to reduce the surface roughness of the groove.

The present invention further provides a solid guide bar which is less susceptible to failure and provides an increased useful life as well as assisting high speed operation.

BRIEF DESCRIPTION OF THE DRAWINGS

The present invention will be described in greater detail with reference to the accompanying drawings, wherein like members bear like reference numerals and wherein.

DETAILED DESCRIPTION OF THE PREFERRED EMBODIMENT

Figure 1:
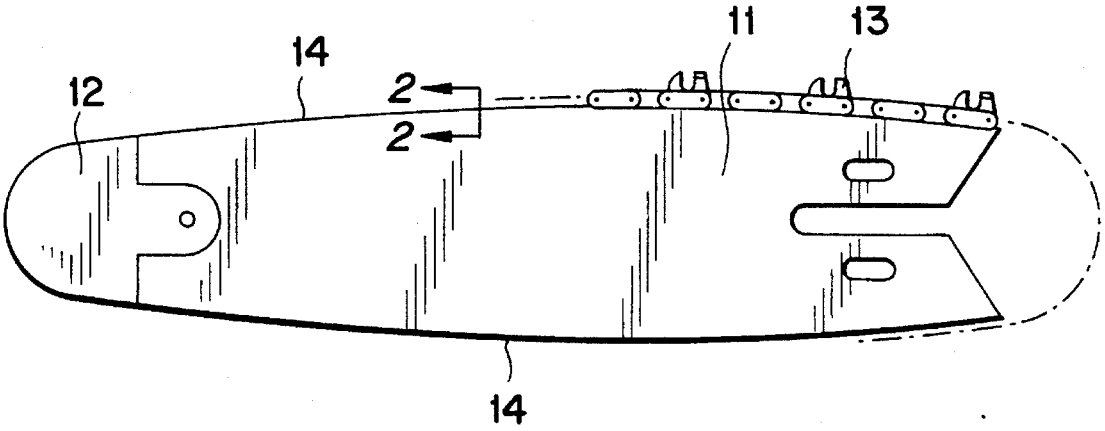
FIG. 1 is a side view of a guide bar according to the present invention.
Figure 2:
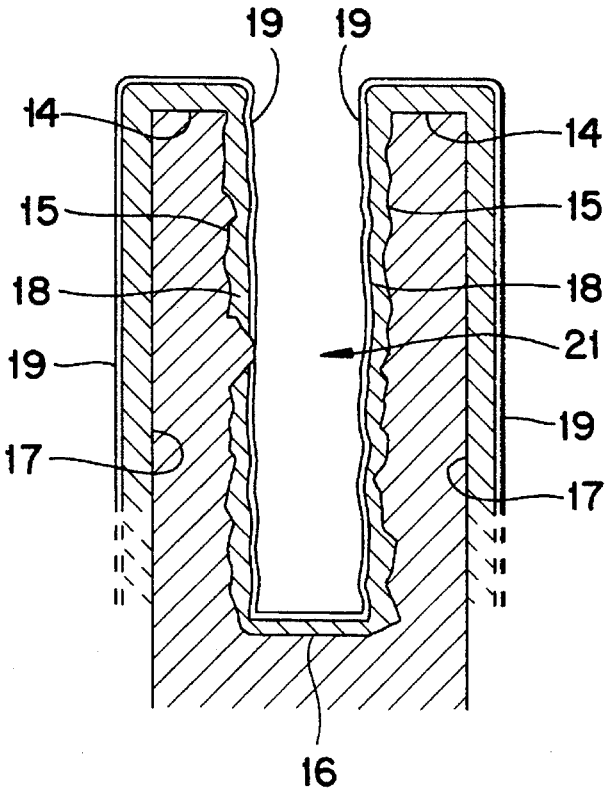
FIG. 2 is an enlarged cross-sectional view through the groove in the guide bar taken along the line 2—2 of FIG. 1.

With reference to FIG. 1, a solid guide bar comprises a bar body 11 with a nose 12 which is usually a separate item fastened to the bar body by rivets. A saw chain 13 is adapted to travel along the bar body and around the nose, supported by upper edges 14 of the bar body 11 and guided by a groove 21 formed, in the bar body 11. The groove 21 is defined by side walls 15 and a bottom 16. The groove is machined and made sufficiently deep so that drive links of the saw chain 13 will not reach the bottom 16. Normally, the drive links will extend from 50 to 75% of the depth of the groove 21.

The bar body 11 has flat sides 17 which are usually the original rolled surfaces of a plate from which the bar body 11 is formed by punching or laser cutting. There is no technical need for the sides 17 to be smoother than when formed after burrs from the punching or laser cutting have been removed. The upper edges 14 are finely ground as part of the normal fabrication. The groove 21 is machined into the bar body by milling or grinding of the bar body 11. There is no requirement for smoothness at the groove bottom 16 as nothing will rub against it.

The roughness of the groove side walls 15 has a crucial influence on the friction and wear of the groove and the saw chain 13. The roughness achievable by milling or deep grinding, normally Ra=5 to 10 microns, can be considerably improved according to the invention by plating the groove, at least on those parts of the side walls 15 which can be touched by the drive links of the saw chain, with a first material layer 18 with an average thickness sufficient to encompass the average surface roughness and preferably 5 to 15 microns, followed by a second, substantially thinner layer 19, preferably of a thickness of 0.25 to 1 micron. The principal purpose of the first layer is to fill the valleys of the machined surface while the second layer is provided to present a smooth, reduced friction surface. The second layer must have a hardness that is sufficiently high to withstand the stresses produced by the rapidly moving saw chain. In a preferred embodiment, the first layer 18 is comprised of nickel while the second layer 19 is comprised of chromium. It is also contemplated that the first layer could be comprised of cadmium while the second layer is comprised of zinc. Other suitable coating materials may also be used.

The first, nickel layer 18 is preferably deposited from an acid electrolytic bath with organic additives according to known art, ensuring that the nickel will be deposited predominantly in the valleys of the surface structure to make the surface bright and smooth. The second, chromium layer 19 will adhere predominantly to the nickel and improve its wear resistance, while leaving any remaining steel asperities or peaks protruding beyond the thickness of the first layer 18 unprotected and easily worn down. The result is a surprising reduction in friction between the groove walls and the saw chain. That reduced friction produces a noticeable increase in chain velocity and an increased lifetime of the guide bar until the groove is too worn. The life of the guide bar according to the present invention may be 2–3 times the lifetime of solid guide bars with unplated grooves.

During plating of the groove side walls 15, it is difficult to avoid plating of the upper edges 14. The plating of the edges also improves the friction of the saw chain against the edges particularly at high speeds and/or loads. Further, at least a portion of the bar body sides 17 is generally plated. This plating has both an esthetic effect and may reduce sticking of tree sap or other materials to the surface of the bar body thereby facilitating use of the guide bar. The groove bottom 16 may have a plating of much reduced thickness or none at all, which is of no consequence, since the plating is not needed there.

If the nose 12 is a separate part comprising a sprocket to carry the chain 13, there is no need to plate the nose. If the nose is lacking a sprocket, the nose should be plated along with the rest of the guide bar.

The principles, preferred embodiments and mode of operation of the present invention have been described in the foregoing. However, the invention which is intended to be protected is not confined to the foregoing specification but is described in the following claims.

What is claimed is:

1. A guide bar for chain saws, comprising a bar body made from a solid steel plate with outer edges, sides and a groove previously machined along the edges to guide a saw chain, said groove being defined by groove side walls and a groove bottom, the groove side walls and groove bottom being internal of the outer edges and within the bar body, at least half of the groove side walls extending from the outer edges being plated with a first material layer internal of the side walls followed by a second material layer internal of the first material layer which is thinner than the first material layer.

2. The guide bar according to claim 1, wherein the first material layer is nickel and the second material layer is chromium.

3. The guide bar according to claim 1, wherein the thickness of the first material layer is 5 to 15 microns (0.0002 to 0.0006 inch).

4. The guide bar according to claim 3, wherein the first material layer is electrolytically deposited.

5. The guide bar according to claim 1, wherein the ratio of the thickness of the first material layer to the second material layer is greater than 5 to 1.

6. The guide bar according to claim 1, wherein the ratio of the thickness of the first material layer to the second material layer is greater than 10 to 1.

7. The guide bar according to claim 1, wherein the thickness of the second material layer is no more than 1 micron (0.00004 inch).

8. The guide bar according to claim 1, wherein the plated layers extend over the outer edges.

9. The guide bar according to claim 1, wherein the plated layers extend over the outer edges and at least partially along sides of the bar body.

10. The guide bar according to claim 3, wherein the thickness of the second material layer is no more than 1 micron (0.00004 inch).

11. The guide bar according to claim 5, wherein the thickness of the second material layer is no more than 1 micron (0.00004 inch).

12. The guide bar according to claim 1, wherein the first material layer has a thickness correlated with the average surface roughness of the groove side walls.

13. The guide bar according to claim 9, wherein the average surface roughness of the groove side walls is Ra=5 to 10 microns.

14. The guide bar according to claim 1, wherein the first material layer is sufficiently thick to fill valleys in the surface of the groove side walls.

15. The guide bar according to claim 1, wherein the second material layer provides a smooth wear resistant surface.

16. The guide bar according to claim 1, wherein the first material layer is deposited on the bar body from an acid electrolytic bath.

* * * * *